United States Patent [19]

Gleichaut et al.

[11] Patent Number: 4,532,868

[45] Date of Patent: Aug. 6, 1985

[54] ROTATING BAND FOR PROJECTILES

[75] Inventors: Winfried Gleichaut, Oberndorf; Oswin Günther; Dietrich Hoffmann, both of Schramberg; Rolf Funke, Bad Schonborn, all of Fed. Rep. of Germany

[73] Assignees: Mauser-Werke Oberndorf GmbH; Karl Schmidt GmbH, both of Fed. Rep. of Germany

[21] Appl. No.: 564,209

[22] Filed: Dec. 22, 1983

[30] Foreign Application Priority Data

Dec. 24, 1982 [DE] Fed. Rep. of Germany ..... 3248011

[51] Int. Cl.[3] ..... F42B 31/00

[52] U.S. Cl. ..... 102/527

[58] Field of Search ..... 102/520–527

[56] References Cited

U.S. PATENT DOCUMENTS

| | | | |
|---|---|---|---|
| 2,360,473 | 10/1941 | Calkins | 102/562 |
| 2,442,369 | 7/1942 | McBride | 102/93 |
| 2,856,856 | 10/1958 | Michael | 102/526 |
| 2,928,348 | 3/1960 | Zisman et al. | 102/527 |
| 2,996,012 | 8/1961 | Butler | 102/527 |
| 3,289,533 | 12/1966 | Brown | 102/525 |
| 3,687,079 | 8/1972 | Scollins | 102/526 |
| 4,005,660 | 1/1977 | Pichard | 102/501 |
| 4,193,347 | 3/1980 | Stier et al. | 102/433 |
| 4,446,795 | 5/1984 | Price et al. | 102/527 |

FOREIGN PATENT DOCUMENTS

| | | |
|---|---|---|
| 1578097 | 1/1971 | Fed. Rep. of Germany . |
| 2551389 | 5/1977 | Fed. Rep. of Germany . |
| 3008912 | 9/1980 | Fed. Rep. of Germany . |

*Primary Examiner*—Harold J. Tudor

*Attorney, Agent, or Firm*—McGlew and Tuttle

[57] ABSTRACT

A rotating band of projectiles is made of a compound sleeve bearing material. The compound material comprises a carrier material and a porous slide layer applied thereto and having pores filled with a polytetrafluoroethylene mixture. The outer surface of the slide layer is coated with a cover layer of a polytetrafluoroethylene mixture. The rotating band is held in place in the groove by a latching connection.

11 Claims, 7 Drawing Figures

ROTATING BAND FOR PROJECTILES

FIELD AND BACKGROUND OF THE INVENTION

The invention relates in general to projectiles and in particular to a new and useful rotating band for projectiles, which can be inserted into an annular groove of a projectile body.

The high performance of modern rapid-fire arms and machine guns produces a negative effect on the life of the barrels. A substantial contribution to the extension of the life of barrels is the use of suitable materials for the rotating bands of the ammunition. However, limits are set in the prior art to the use of these materials, because of both the high temperatures produced in the barrels particularly due to very high firing rates and long bursts of fire, and the high gas pressures developed with modern powders and the securing of the spindle and elimination of the gas slip.

For example, rotating bands of sintered iron are known from German OS Nos. 25 51 389 and 30 08 912. This has an advantage in manufacture, since the annular rotating bands can be produced individually in a pressing process. Further, sintered iron is suitable since it maintains satisfactory slide properties even at relatively high temperatures. Only, the gas slip can be entirely avoided with rotating bands of sintered in.

German OS No. 15 78 097 indicates how to reduce the wear of barrels by admixing a heat resistant plastic, namely polytetrafluoroethylene into a rotating band of a fibrous material.

SUMMARY OF THE INVENTION

The present invention is directed to an improvement in the slide properties of rotating bands while preserving a good heat resistance and providing for better sealing, and a satisfactory imparting of the spin within the barrel.

This is obtained in accordance with the invention by providing a rotating band made of a compound slide bearing material. According to another feature of the invention, this material may comprise a carrier material and a slide layer applied thereto. The slide itself is advantageously a compressive body having a porous structure with pores filled with a plastic.

In another embodiment of the invention, the compound slide bearing material advantageously comprises a carrier material and a metallic slide layer sintered thereon as a porous structure whose open pores are filled with a plastic. The slide layer without plastic may be applied to the carrier material either by plating, or by casting. A development of the invention provides a slide layer made from a bronze powder. This slide layer may also be made of a tin bronze. In a particular advantageous embodiment the material of the slide layer is a tin bronze with a proportion of 5% to 20% by volume of tin, and an admixture of 0.5% to 50% by volume of lead.

The preferred proportions are between 5% and 15% by volume of tin, and between 5% and 25% by volume of lead.

In another inventive embodiment, the slide layer advantageously contains a filler of polytetrafluoroethylene mixture, particularly a polytetrafluoroethylene mixture containing 10% to 30% by volume of lead and/or lead oxide. The rotating band is further provided with a cover layer of plastic, preferably a polytetrafluoroethylene mixture, forming a coating of the outer surface of the band.

Materials which are employed for making slide bearings have favorable properties contributing to their resistance to heat, frictional resistance, strength, sealing compatibility, and ease of manufacture. The inventive admixture of the plastic, namely polytetrafluoroethylene, is to improve the slide properties and, primarily, the sealing between the barrel and the rotating band, resulting in a reduction of gas leakage and the erosion. The reduced erosion contributes to the extension of the life of the barrel.

By providing tin bronze as the sintered material, the thermal resistance of the rotating band is advantageously increased and the band, when in a standby position in the magazine drum before the next discharge, is prevented from fusing.

With high firing rates and during long bursts of fire, extremely high temperatures occur in the barrel and the magazine drum, which are transferred to the ammunition, particularly for the magazine drum, during the standby period. The skin of plastic formed on the surface of the rotating band according to the invention, during the manufacturing process thereof, also contributes to a satisfactory sealing and sliding effect.

According to another embodiment of the invention, the carrier material may extend to fit into recesses or undercuts provided in the annular groove of the projectile body, and the outer diameter of this carrier material portion is smaller than the caliber of the projectile, so that the lens of rifling in the barrel do not cut into the carrier material.

A detachment of the rotating band from the projection body and of the slide layer from the carrier material during the rotation, which might be caused by the occurring centrifugal forces, are thus effectively prevented. The slide layer may have a thickness of 0.5 mm to 2 mm.

In a specific embodiment, the two abutting ends of the annular rotating band may be connected to each other by positive interengagement and/or by a pressure fit. The positive connection may be effected by a latch engaging a corresponding recess of the underside of the band. According to a development of the invention, the latch may have a dovetail or hook like configuration. Particularly advantageous is a substantially circular shape, with recesses in the transition zone to the rotating band. With such designs, the undercuts and recesses in the annular groove of the projectile body may be omitted, since the rotating band is held together by a latching and a bursting open of the band under the centrifugal force is effectively prevented.

The rotating band may further be provided on its annular surface turned to the bottom of the annular groove, or on its front faces, with a corrugation preventing a relative movement or slippage between the rotating band and the projectile body.

Another corrugation may be provided in addition, or instead of the already mentioned one in the annular groove of the projectile. Depending on the design of these corrugations the rotating band may then be either pressed or wound onto the projectile.

To ensure that the spin will satisfactorily be transmitted from the rotating band to the projectile, one or more entraining protrusions may be formed on the band, which engage corresponding recesses provided in the annular groove of the projectile. The imparting of a rotary motion to the band is further ensured by providing that the band is provided with a back or inner portion which is inserted into the annular groove of the projectile and is made considerably wider than the guide portion proper of the rotating band. This back portion is formed substantially by the carrier material. The carrier material or the back portion may be connected to the projectile body by soldering, welding or with an adhesive. The back portion or carrier material projecting on both sides beyond the width of the guide portion or slide layer, may have a diameter which is smaller than that of the projecting of shell, and the thus protruding shoulders of the rotating band may be held on the bottom of the annular groove of the projectile by means of securing elements. The securing elements may be embodied by press-fitted strips, injection molded rings of plastic, or circularly extending welds or soldering seams.

Altogether the following advantages are obtained and functions ensured with the inventive design of the rotating band:

- completely satisfactory imparting of spin to the projectile by the barrel rifling
- minimizing of thermal wear in the barrel
- satisfactory sealing between the barrel and the projectile and elimination of gas leakage
- chemical resistance to hot powder gases
- satisfactory storage capability
- avoiding material depositions in the barrel
- resistance to thermal load while passing through the barrel
- minimizing the mechanical wear of the barrel by a satisfactory sliding and lubricating effect
- preventing peeling off
- resistance to thermal load in the hot magazine drum
- fuel flow disturbances around the projectile under outer ballistic conditions and no feather formation.

Accordingly, it is an object of the invention to provide a rotating band for an external circumferential groove of a projectile which is adapted to be fired from a rifle bore having lands and grooves and which comprises a compound slide bearing including a radially inner carrier having an outer diameter smaller than the projectile caliber so that the lands of the rifling do not cut into the carrier, a porous metal slide layer applied over the exterior surface of the carrier and a plastic filling the pores of the cover layer and with a durable cylindrical plastic over the slide layer forming a coating over the outer cylindrical surface.

A further object of the invention is to provide a projectile having a rotating band which effectively engages the circumference of the projectile body and which is made of a compound slide bearing material and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
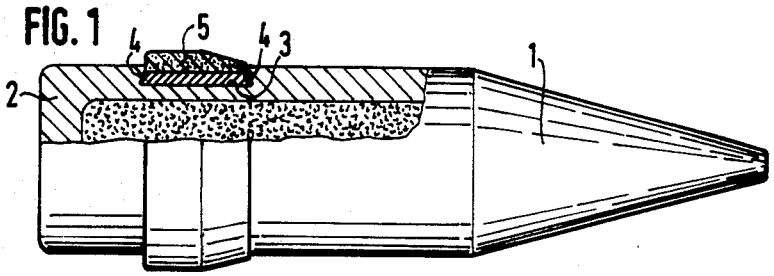
FIG. 1 is a partial axial sectional view and partial elevational view of a projectile provided with a rotating band.
Figure 2:
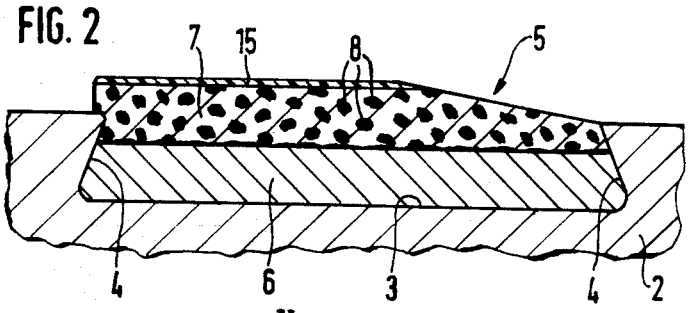
FIG. 2 is an enlarged sectional view of the rotating band as shown in FIG. 1.

Referring to the drawings in particular the invention embodied therein in FIGS. 1 and 2 comprises a rotating band generally designated 5 for an external circumferential groove 3 of a projectile 1 which is adapted to be fired from a rifle bore which has lands and grooves. The band comprises a compound slide bearing including a radially inner carrier 6 having an outer diameter smaller than the projectile caliber so that the lands of the rifling do not cut into the carrier. A porous metal slide layer is applied over the exterior surface of the carrier by casting or plating. In addition, a plastic is applied over the slide layer filling the bores of the slide layer. A cover layer or polytetrafluoroethylene 15 is applied over the slide layer forming a coat over the outer cylindrical surface.

In the rear portion 2 of a projection body 1, an annular groove 3 with back tapers 4 is provided in which a rotating band 5 made from a compound slide bearing material is press-fitted. The compound slide bearing material includes two layers of which a lower one is a carrier material 6 of steel, brass, aluminum of corresponding alloys, while the upper layer is a slide layer 7 which is applied to carrier material 6 and is made from a tin-bronze powder, for example. The applied slide layer 7 is filled with a polytetrafluoroethylene mixture 8. This particular build-up of layers, with an outer cover layer 15 of a plastic which is produced during the rolled-in process for example, extends the life of the barrel quite considerably. Moreover, such rotating bands withstand thermal loads better than, for example, rotating bands of a plastic.

To be able to secure slide bearing rotating bands, to a projectile body, in a process usually employed for sintered iron rotating bands, it is desirable to provide a carrier material 7 having a hardness as close as possible to that of sintered iron. This makes the side bearing rotating band universially applicable, i.e. securable to projectiles having shells of variety of materials, such as steel, aluminum, etc.

The requirements of hardness depend primarily on the capability of the carrier material to be applied by pressure. The sintered layer 7 may therefore be considerably harder than a rotating band of sintered iron, and its hardness, or the hardness of the sliding coatings, is to be adjusted to the specific needs of the system.

While selecting the thickness of slide layer 7, it must be made sure that the lands of the rifling of the barrel will not penetrate farther than into this slide layer, more particularly will not impress themselves to the carrier material 6. The slide layer must therefore always have an outer diameter smaller than the caliber of the projectile. The thickness of the carrier material 6 will depend on the depth of annular groove 3 of projectile body 2.

The outer contour of the rotating band will be determined with regard to the sealing properties and strength of the material. While providing the inventive features, the rotating band cannot be sheared off during its passage through the barrel, and no gas can slip through between the rotating band 5 and inside surface of the barrel. The needed hardness and final geometry of the rotating band 5 is obtained by compressing the material without thereby damaging projectile body 1 or its rear portion 2. In its final extension carrier material 6 fills out undercuts 4 completely and ensures thus a firm seat even under strong centrifugal forces which occur at the very high speeds of the projectiles.

Figure 3:
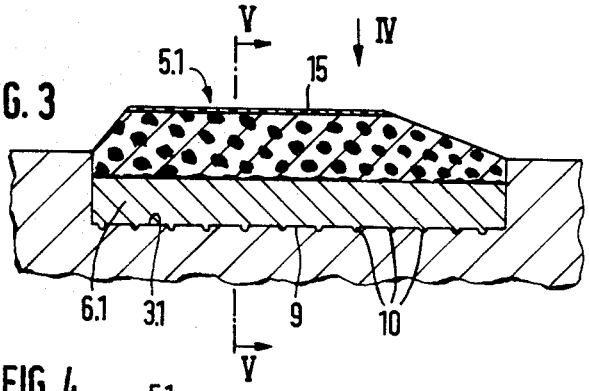
FIG. 3 is a sectional view of another embodiment of the rotating band.
Figure 4:
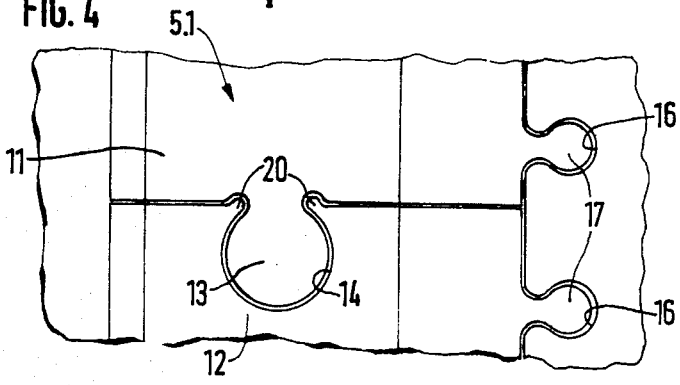
FIG. 4 is a top plan view of the rotating band of FIG. 3, taken in the direction of arrow IV.
Figure 5:
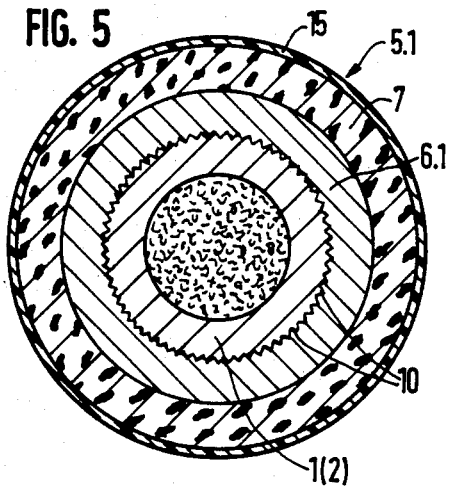
FIG. 5 is a sectional view taken along the line V—V of FIG. 3.

In a rotating band 5.1 according to FIGS. 3, 4 and 5, the carrier material 6.1 is provided on its inner annular surface turned to the bottom 3.1 of the groove, with corrugations 10 which may have the shape of teeth or a knurling.

Figure 6:
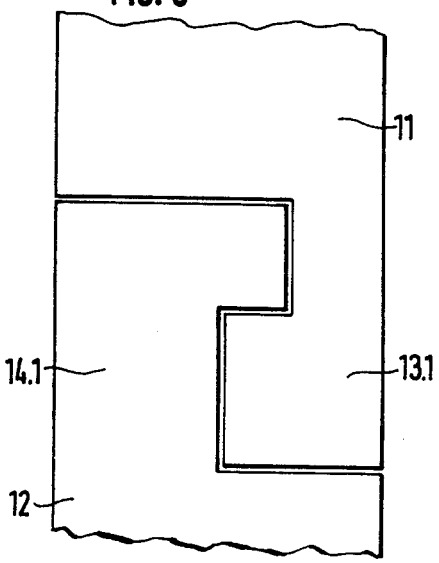
FIG. 6 is a top plan view similar to FIG. 4 of another embodiment of the projectile showing the latching of the two ends of the rotating band.

Upon pressing rotating band 5.1 onto the projectile body, the corrugation penetrates into the groove bottom 3.1 and claws in so that a slippage between a rotating band and the body of the projectile during the spin production is prevented. The two abutting ends 11, 12 of the split rotating band 5.1 are connected to each other by means of a latch, for example a tongue of circular shape, and shown at 13, engaging into a conformable recess 14. The undercut 4 in annular groove 3 may be omitted in this embodiment. Due to the latching, rotating band 5.1 is securely held in place even under strong centrifugal forces. In the transition zone at the end of the rotating band, latch 13 is formed with recesses 20, to prevent tearing of the band at that locations under strong forces. Instead of a substantially circular latch 13, a latch of another shape may be provided, such as a dovetailed one or one of a hook or similar shape 13.1 shown in FIG. 6. The two end portions 11 and 12 of the rotating band are interlocked with each other and prevent the rotating band from bursting open under large centrifugal forces.

According to FIG. 4, one or more recesses 16 may be provided in the sidewall of annular groove 3 of the projectile into which conformable projections 17 of the rotating band are engaged. Recesses 16 may be provided on one or both sides preferably at several locations along the circumference of the projectile. This is particularly instrumental for an entirely satisfactory imparting of the spin.

Figure 7:
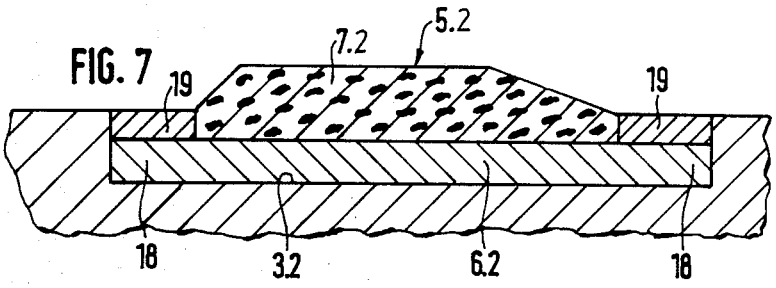
FIG. 7 is a sectional view of another embodiment of the rotating band having a wider back portion and associated with securing elements.

According to FIG. 7 to secure the imparting of the spin, the carrier material of rotating band 5.2 form a back 6.2 which is received in groove 3.2 and enlarged on both sides relative to slide layer 7. At the two ends protruding beyond slide layer 7.2, back 6.2 has a diameter which is smaller than that of projection body 1. The shoulder 18 thus formed are held fast at groove bottom 3.2 through securing element 19. Securing elements 19 may be embodied as press-fitted metal rings or as injection molded rings of plastic. Solder seams or welds are also considered as securing elements covered by the present invention.

While specific embodiments of the invention have been shown and described in detail to illustrate the application of the principles of the invention, it will be understood that the invention may be embodied otherwise without departing from such principles.

We claim:

1. A projectile having a caliber and adapted to be fired from a rifle bore having rifling with lands and grooves, comprising:

a projectile body having an external circumferential groove; and a rotating band in said groove comprising a compound slide bearing;

said rotating band including a radial inner carrier having an outer diameter which is smaller than the projectile caliber so that the lands of the rifling do not cut into said carrier, a split annular one piece porous metal slide layer over and secured to the exterior surface of said carrier, said slide layer having ends, a polytetrafluoroethylene filling pores of said porous metal slide layer, a cover layer of polytetrafluoroethylene over said slide layer, said slide layer having an outer cylindrical surface covered by said cover layer, and means for positively engaging said ends of said slide layer which comprise a latch tongue on one end of said slide layer engaged with a receiving groove on the other end of said slide layer.

2. A projectile according to claim 1, wherein said slide layer is made of a material including at least one of said bronze powder and tin-bronze powder.

3. A projectile according to claim 2, wherein said polytetrafluorothylene filling contains from 10% to 30% by volume lead.

4. A projectile according to claim 2, wherein said polytetrafluoroethylene filling contains from 10% to 30% by volume of lead oxide.

5. A projectile according to claim 2, wherein said slide layer has a thickness of from 0.5 mm to 2 mm.

6. A projectile according to claim 2 wherein said projectile body has undercuts on each side of said groove, said carrier extending into said undercuts.

7. A projectile according to claim 2, wherein said latch tongue is circular, said receiving groove being circular and receiving said circular latch tonue.

8. A projectile according to claim 2, wherein said latch tongue and receiving groove are hook-shaped and complementary and are engaged with each other.

9. A projectile according to claim 2, wherein said carrier is connected to said projectile body by soldering.

10. A projectile according to claim 2, wherein said carrier is connected to said projectile body by welding.

11. A projectile according to claim 2, wherein said carrier is connected to said projectile body by adhesive.

* * * * *